US006250045B1

(12) United States Patent
Goer et al.

(10) Patent No.: US 6,250,045 B1
(45) Date of Patent: Jun. 26, 2001

(54) SPACING PROFILE FOR DOUBLE-GLAZING UNIT

(75) Inventors: Bernhard Goer, Recklinghausen; Franz-Josef Rotmann, Essen; Juergen Regelmann, Witten, all of (DE)

(73) Assignee: Flachglas Aktiengesellschaft, Fuerth (DE)

( * ) Notice: Subject to any disclaimer, the term of this patent is extended or adjusted under 35 U.S.C. 154(b) by 0 days.

(21) Appl. No.: 09/300,103

(22) Filed: Apr. 27, 1999

(30) Foreign Application Priority Data

Apr. 27, 1998 (DE) ..... 298 07 419 U
Dec. 23, 1998 (DE) ..... 198 59 866

(51) Int. Cl.[7] ..... E06B 7/12
(52) U.S. Cl. ..... 52/786.13; 52/172
(58) Field of Search ..... 52/172, 786.13, 52/786.1

(56) References Cited

U.S. PATENT DOCUMENTS 5,079,054 * 1/1992 Davies ..... 52/172 X
5,512,341 * 4/1996 Newby et al. ..... 52/786.13 X
5,962,090 * 10/1999 Trautz ..... 52/786.13 X
6,035,602 * 3/2000 LaFond ..... 52/172 X
6,061,994 * 5/2000 Goer et al. ..... 52/172 X

FOREIGN PATENT DOCUMENTS 33 02 659 A1 8/1984 (DE) .
298 14 768 U1 2/1999 (DE) .

* cited by examiner

*Primary Examiner*—Christopher T. Kent
(74) *Attorney, Agent, or Firm*—Marshall & Melhorn, LLC

(57) ABSTRACT

A spacing profile for a spacing frame, which is to be fitted in the edge area of a double-glazing unit, forming an interspace, with a profile body of a material possessing low thermal conductivity. The spacing profile additionally comprises a desiccant cavity, and further a metal foil, which extends essentially over the entire width of the spacing profile. Only the metal foil together with a center piece of the connecting flanges forms the walls of the desiccant cavity.

33 Claims, 3 Drawing Sheets

SPACING PROFILE FOR DOUBLE-GLAZING UNIT

BACKGROUND OF THE INVENTION

1. Field of the Invention

The invention concerns a spacing profile for a spacing frame, which is to be fitted in the edge area of a double-glazing unit, forming an interspace, with a profile body of a plastic material possessing low thermal conductivity and with a diffusion-impermeable metal foil which is bonded to the profile body so as to establish a material fit.

In particular, the invention relates to spacing profiles of the aforementioned type where the profile body incorporates contact flanges for contact with the insides of the panes of the double-glazing unit and a connecting flange bridging the interspace in installed state, by means of which at least two contact flanges are connected to one another, where the spacing profile additionally comprises a desiccant cavity arranged between the contact flanges and a metal foil which extends essentially over the entire width of the spacing profile, where the metal foil is bonded to establish a material fit to cavity-side surfaces of the contact flanges, as well as to adjacent end sections connecting flange.

The profile body made of plastic material which possesses low thermal conductivity represents the principle part of the spacing profile in respect of volume and imparts its cross-sectional profile to it.

Within the scope of the invention, the panes of the double-glazing unit are normally glass panes of inorganic or organic glass, without the invention being restricted thereto. The panes can be coated or otherwise finished in order to impart special functions to the double-glazing unit, such as increased thermal insulation or sound insulation.

2. Description of the Prior Art

For a considerable time, instead of metal spacing profiles, plastic spacing profiles have been used in order to take advantage of the low thermal conduction of these materials. By materials with low thermal conductivity are generally meant those which possess a coefficient of thermal conductivity which is significantly lower than that of metals, that is to say at least by a factor of 10. The coefficients of thermal conductivity X are typically of the order of 5 W/(m*K) and less; preferably, they are lower than 1 W/(m*K) and more preferably lower than 0.3 W/(m*K).

Of course, plastics generally possess low impermeability to diffusion in comparison with metals. In the case of plastic spacing profiles, it is therefore necessary to ensure by special means that atmospheric humidity present in the environment does not penetrate into the interspace to the extent that the absorption capacity of the desiccant generally accommodated in the spacing profiles is not soon exhausted, thus impairing the reliability performance of the double-glazing unit. Furthermore, a spacing profile must also prevent filler gases from the interspace, such as for example argon, krypton, xenon, sulphur hexafluoride, escaping from it. Conversely, nitrogen, oxygen etc., present in the ambient air may not enter the interspace. Where impermeability to diffusion is involved below, this means impermeability to vapor diffusion, as well as impermeability to gas diffusion for the gases stated.

To improve the impermeability to vapor diffusion, DE 33 02 659 A1 suggests to provide a plastic spacing profile with a vapor barrier by fitting a thin metal foil or a metallized plastic film on the plastic profile on the surface which faces away from the interspace in the installed state. This metal foil must fully span the interspace so that the desired vapor barrier effect occurs.

Nowadays, it is preferred to produce one-piece spacing frames from spacing profiles which are bent at three or four corners and for which joining of the end sections is effective by means of corner connectors inserted in the end sections or a straight connector. Here, an endeavor is made to carry out the corner bending as simply as possible in production, in particular without expensive prior heating.

In order to permit cold-bending of spacing profiles made of materials with low thermal conductivity, spacing profiles have been developed, where the profile body of material with low thermal conductivity and being elastically-plastically deformable is bonded to a plastically deformable reinforcing layer, preferably a metal layer, so as to establish a material fit. This reinforcing layer can also be impermeable to diffusion and span the entire width of the interspace, as a result of which the necessary impermeability to diffusion of the spacing profile is achieved. Such a spacing profile has been introduced under the name THERMOPLUS® TIS for example in the brochure "Impulse für die Zukunft (Impulses for the Future)" of Flachglas AG, Germany, and is described in the utility model DE 298 14 768 U1, which has an earlier priority date than the present patent application. In a preferred embodiment of this spacing profile, a polypropylene homopolymer having a Young's modulus of elasticity (modulus of elasticity) of 1,900 $N/mm^2$ is used, whereas the reinforcing layer is fabricated from sheet iron having a thickness of less than 0.2 mm or from stainless steel having a thickness of less than 0.1 mm.

Spacing profiles consisting of a plastics-metal-foil sandwich generally have proved in practice. Though, there is still the problem that the cold-bendability, in particular in the area of the desiccant cavity, is limited. As the desiccant cavity is relatively rigid by virtue of its closed structure reinforced on three sides, this area can only be cold-bent with difficulty. Thus, it is of course thoroughly desirable for the contact flanges, that they should, on account of the sandwich construction of elastically-plastically deformable profile body material and plastically deformable (metal) reinforcing layer, possess a high degree of rigidity, so that the contact flanges should present a flat contact surface, even after cold-bending. In the case of the desiccant cavity, a high level of rigidity has however been found disadvantageous. Above all, the side walls of the desiccant cavity impart to the profile, in accordance with the state of the art, a comparably high moment of resistance to bending so that, during the cold-bending process, uncontrolled bulging of the side walls towards the contact flanges or undesirable deformation of the connecting flange can occur.

In single cases, it had also been observed that in particular at high bending speeds high level deformation forces occurred at some regions, so that the material fit between profile body and metal foil could not be maintained, whereupon the metal foil peeled off the profile body at some regions and showed cracking there. In particular, the free ends of the contact flanges of a profile according to DE 298 14 768 U1 are at risk, where the metal foil experiences a high deformation stress even during manufacture of the spacing profile. The uncontrolled foil separation and tears lead to impairment of the vapor-barrier effect and to mechanical instability of the profiles.

SUMMARY OF THE INVENTION

The object of the present invention is to provide a cost-effectively producible spacing profile which, to achieve satisfactory thermal insulation, incorporates a profile body of material with low thermal conductivity which is provided with a metal foil to ensure sufficient diffusion-impermeability and where the cold-bendability as compared with the previously known profile is further improved, where undesirable deformation of the profile body, in particular of the connecting flange, and tears in the metal foils as well as undesirable foil separations can be more effectively prevented during the cold-bending process, even in profile areas which are highly stressed.

According to a first aspect of the invention it is provided that solely the metal foil itself together with a center piece of the connecting flange of material with low thermal conductivity should form the walls of the desiccant cavity. Thus apart from one wall, with this embodiment all the walls of the desiccant cavity are formed only of plastically deformable thin metal foil, not reinforced with a plastic layer or the like. By this means, it is possible surprisingly to achieve satisfactory cold-bendability of the profile, although tho desiccant cavity of the profile according to the invention possesses a comparatively low moment of resistance to bending. Hitherto, one was in fact convinced that a high moment of resistance to bending basically improves the cold-bendability. The walls of the desiccant cavity formed of metal foil deform more easily than the profile according to the state of the art from DE 298 14 768 U1 and over a longer profile section, so that the risk of cracking of the metal foil during bending is significantly reduced. Of course, the thickness of the metal foil may not be excessive, so that the desired satisfactory deformability of the walls of the desiccant cavity formed by the metal foil is achieved. In practice, the foil thickness will be chosen as low as possible, so that adequate impermeability to diffusion is maintained, the walls of the cavity still withstand bending free from cracks and the thermal conduction through the profile is as low as possible.

The inventive configuration of the spacing profile has accordingly proved successful in so to speak structurally separating the area especially critical for the cold-bendability next to the contact flanges of the desiccant cavity integrated in the profile body according to the previously known teaching, so that during the bending process no excessive deformation forces can act on the connecting flange of material with low thermal conductivity or on the contact flanges.

In a second aspect of the spacing profile according to the invention as well, all the walls of the desiccant cavity, apart from the inner wall formed by a center section of the connecting flange, are formed by the metal foil, where however at variance from the first embodiment, one or more of these walls are provided with a thin reinforcing layer of material with low thermal conductivity, whose thickness is however a maximum of 50% of the thickness of the connecting flange. In preference, an elastically-plastically deformable material, in particular a plastic material is used. By means of this design, it is possible, if necessary, to achieve selective local reinforcement of the desiccant cavity walls, without however the reinforcing layer assuming the structural function of the metal foil in this area of the profile and without the thermally insulating properties of the profile being significantly impaired. The reinforcing layer of the cavity walls is to be of an insignificant dimension, such that the metal foil still remains sufficiently readily deformable and that undesirably high deformation forces acting on the connecting flange when bending the profile are prevented. Here, it is possible, for example, by the use of a thin reinforcing layer to ensure that the desiccant cavity is not deformed when handling the profile or that deformation of the cavity walls during cold bending is specifically controlled. Also with this embodiment of the invention, on account of the insignificant thickness of the reinforcing layer in the area of one or more of the cavity walls formed by the metal foil, as compared with the connecting flange, the structural separation of the profile body from the desiccant cavity mentioned in connection with the first embodiment is to a large extent maintained.

Preferably, in both aspects, the desiccant cavity of the profile according to the invention comprises two side walls which are arranged essentially parallel to the adjacent contact flanges, as well as at least one outer wall facing away from the interspace in the installed state, which outer wall is essentially parallel to the connecting flange. In this case, the contact flanges joined to the metal foil, the end sections of the connecting flange joined to the metal foil, as well as the adjacent side walls of the desiccant cavity formed by the metal foil each form a U shape open to the outer edge of the double-glazing unit in installed state. This achieves an especially favorable cold-bendability of the spacing profile; in addition, by virtue of the U shape of the metal foil, the path formed by it of relatively high thermal conduction from one pane inside to the other pane inside is significantly extended, which contributes to improved thermal insulation of the spacing profile. Preferably, the length of the U limb of the metal foil is significantly greater than the length of the U base of the metal foil, and in particular even more than five times as great. This also ensures that the path of thermal conduction through the most efficiently thermally conductive material, that is to say the metal foil, is maintained as long as possible. Of course, the contact flanges and the adjacent side walls of the desiccant cavity can be of different lengths. In this case, the aforementioned dimensioning of the longer of the two U limbs will apply.

Generally, "side walls" will in each case mean the walls of the desiccant cavity nearest to the panes in installed state, irrespective of whether they are parallel to the panes in installed state or not.

In a preferred embodiment of the second variant, the side walls of the desiccant cavity are provided with a thin reinforcing layer of material with low thermal conductivity. By this means, it is possible to prevent undesirable bulges in the side walls during cold bending, without however undesirably high deformation forces acting on the connecting flange. The thickness of the reinforcing layer of the side walls is preferably less than one third, more preferably less than one quarter of the thickness of the connecting flange.

Supplementary or alternatively thereto, the outer wall of the desiccant cavity facing away from the interspace in installed state is provided with a reinforcing layer of material with low thermal conductivity. By this measure, it is possible to achieve increased stability of the profile during handling, without the thickness of the metal foil, and thus the thermal conduction, having to be increased for this purpose. Again, the thickness of the reinforcing layer of the outer wall is preferably less than one third, more preferably less than one quarter of the thickness of the connecting flange.

In the case of an especially preferred embodiment, at least a portion of the reinforcing layer is arranged on the inside of the walls of the desiccant cavity formed by the metal foil facing towards the interior of the cavity. This simplifies the manufacturing process for the profile, especially when the reinforcing layer is manufactured from the same material as the connecting flange.

In a further embodiment, the reinforcing layer covers the metal foil at least partially on both surfaces, so that the metal foil is, so to speak, embedded in these areas in the reinforcing layer, where it is to be ensured that the total thickness of the reinforcing layer, even in these areas, is not more than 50% of the thickness of the connecting flange, so as not to increase the rigidity of the cavity walls excessively. By embedding the metal foil in the reinforcing layer of (plastic) material with low thermal conductivity, the former can be protected in especially endangered areas from mechanical or chemical impairment. In addition, it is possible by this means to specifically influence the visual appearance of the spacing profile.

The spacing profile according to the invention is preferably manufactured by deforming the metal foil according to the desired cross-section while forming the walls of the desiccant cavity. Subsequently, a thermoplastic material which forms the profile body, i.e. the connecting flange, the contact flanges and—optionally—the reinforcing layer, is applied to the preformed metal foil by extrusion, so that a material fit of the both components is established.

The desired cold-bending behavior can be achieved, surprisingly, also by a specific setting of the rigidity of the plastic material of the profile body.

According to a third aspect of the invention, provision is thus made for a plastic material with a bending modulus of elasticity (according to DIN 53 457) of less than 1,900 $N/mm^2$, in particular less than 1,500 $N/mm^2$, to be used for at least the parts of the profile adjoining the metal foil. In this way it is possible to achieve the effect that the metal foil, at least in the areas especially prone to tearing, is contiguous to a relatively soft and readily deformable material, so that local peak stresses are prevented during cold-bending. According to this aspect of the invention, in particular spacing profiles having desiccant cavities and contact flanges joined thereto through bridge sections, and in particular the spacing profiles of the first both aspects of the invention can be improved regarding the cold-bending characteristics.

Preferably, the complete profile body will be produced entirely of a plastic material with a bending modulus of elasticity adjusted according to the invention, which will simplify manufacture and reduce the manufacturing costs. It lies within the scope of the invention, however, to manufacture parts of the profile, such as for example the profile inner wall contiguous to the interspace, of a more rigid material, in order to impart increased rigidity to the profile. This can for example take place by using another plastic material of higher bending modulus of elasticity or by addition in some areas of customary reinforcing agents to the plastic material used according to the invention, where these reinforcing agents are preferably glass fibers. Here, it is possible to resort to materials known from the state of the art. From EP 0 745 470 A1, for example, a homogeneous profile bar is also known which can be used as spacing profile for double-glazing units, which consists of a polyolefine with embedded glass fibers. Here, modulus of elasticity values of 5,500 $N/mm^2$ and above are reached. In addition, a spacing profile for double-glazing units is known from EP 0 127 739 B1 which consists of a polypropylene filled with glass fibers or mineral powder.

Another alternative consists of using a plastic material adjusted according to the invention only for the parts of the profile body especially at risk, in particular for walls or contact flanges bonded to the metal foil, arranged approximately parallel to the pane plane in installed state, and to produce the remainder of the profile body subjected to less mechanical strain during cold-bending of a material with a higher bending modulus of elasticity.

The plastic material will preferably possess a tensile strength at yield (according to DIN EN ISO 527-1) of less than 38 $N/mm^2$, preferably a maximum of 30 $N/mm^2$, and an elongation at yield (according to DIN EN ISO 527-1) of over 7%, preferably at least 8%.

On account of the low bending modulus of elasticity of the plastic material used for the profile body or parts thereof and of the associated low tensile strength at yield or high elongation at yield of this material, the spacing profile is overall more readily deformable with avoidance of local peak stresses, so that the risk of separation or even tearing of the metal foil during cold-bending is significantly reduced. On the other hand, the rigidity of the spacing profile can be maintained at such a high level by bonding the metal foil to the profile body so as to form a material fit in case of using a suitable profile geometry that undesirable deformation of the spacing profile can be prevented during cold-bending, especially in the region of contact flanges.

Especially when the profile body consists entirely of a plastic material with low bending modulus of elasticity according to the invention, the bending modulus of elasticity should not be less than a value of 900 $N/mm^2$, so that the rigidity of the profile as a whole is still sufficiently high.

Further, improved cold-bending properties are achieved with a plastic material whose percentage elongation at break (according to DIN EN ISO 527-1) is at least 100%, preferably 500%. The effect of this is that, even in the region of plastic deformation following the elastic deformation of the plastic material, no tear can occur in the plastic profile body which would lead to local excessive mechanical loading of the metal foil during bending.

With the optimized mechanical material properties of the plastic material used for the profile body, the inventive sandwich of profile body and metal foil possesses the necessary mechanical properties (cold-bendability) for problem-free manufacture of one-piece spacing frames, as well as the high level of impermeability to diffusion and low level of thermal conductivity required for use in double-glazing units.

Basically, several plastic materials can be used for implementation of the invention. Preferably of course, the plastic materials used include polypropylene as principal constituent. Especially preferred are polypropylene block copolymers, especially those with grafted polypropylene or polyethylene. This material group possesses an especially favorable range of properties in connection with the purpose of the invention.

The material for the profile body which is preferred according to the invention, is generally suitable to manufacture a profile which profile body comprises a hollow profile of rectangular cross-section which encloses a cavity to accommodate desiccant. Of course, the cavity must incorporate perforations or the like in the inner wall facing towards the interspace in order to establish a gas-conducting connection with the interspace. This aspect of the invention is, however, to be used to special advantage in the case of spacing profiles according to DE 298 14 768 U1. In this case, the profile body incorporates contact flanges for contact with the inside of a pane which are joined via bridge sections to a desiccant cavity. The metal foil is bonded to the contact surface of the contact flanges, to the surfaces of the bridge sections facing away from the interspace and to the outer surfaces of the walls of the desiccant cavity so as to establish a material fit.

In a preferred embodiment of the invention it is provided that the metal foil is arranged at least on a portion of the contact surfaces of the contact flanges facing to the insides of the panes in the installed state. By this means, an increased stability of the contact flanges during cold-bending as well as a good adhesion to the sealing material is achieved.

The occurrence of tears during cold-bending can be prevented especially sufficiently if the metal of the metal foil is selected so that its elongation at break (according to ISO) is more than 15%.

The thickness of the metal foil is preferably between 0.02 mm and 0.3 mm, especially preferably between 0.1 mm and 0.15 mm, while the thickness of the connecting flange is preferably between 0.5 mm and 1.5 mm. This dimensioning of the principal components of the spacing profile according to the invention has proved satisfactory in imparting favorable cold-bendability when using known materials and being able to produce the profile cost-effectively.

Suitable materials for the metal foil are in particular stainless steal or chromium-plated or tin-plated sheet iron, where the thickness of the metal foil should be at most 0.2 mm and at least 0.05 mm, in case of sheet iron at least 0.1 mm.

Preferred values for the thickness of the metal foil are approximately 0.08–0.1 mm in the case of stainless steal and approximately 0.1–0.13 mm in the case of sheet iron.

BRIEF DESCRIPTION OF THE DRAWINGS

The invention will be explained below with the aid of the embodiments illustrated in the figures. These show.

DESCRIPTION OF THE PREFERRED EMBODIMENT

Figure 1:
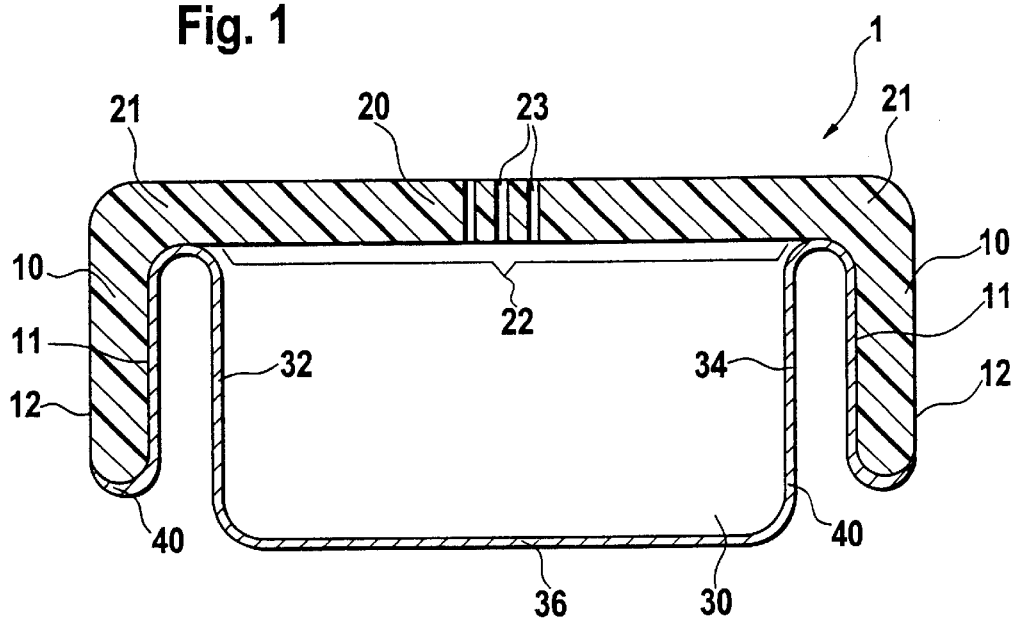
FIG. 1 a first embodiment of a spacing profile according to the invention.

FIGS. 1 to 5 show cross-sectional views of spacing profiles according to the invention. Apart from manufacturing tolerances, this cross-section does not normally change over the entire length of a spacing profile.

Identical or similar elements in the different embodiments have been provided with the same reference numerals. The drawings are only diagrammatical; in particular the thickness of the metal foil is not represented to scale.

FIG. 1 shows a first embodiment of a spacing profile according to the present invention. The profile body comprises two contact flanges 10 for contact in each case with the inside of a pane of a double-glazing unit and a connecting flange 20 which connects the contact flanges 10 with one another and in detailed state bridges the interspace. The profile body has been manufactured in the example illustrated from black-tinted polypropylene Novolen 1040 K with a thickness of 1 mm. It is however preferred to use one of the materials 1 or 2 further characterized below according to the third aspect of the invention.

As metal foil 40, a chromium-plated sheet iron foil with a thickness of 0.125 mm was used. The metal foil 40 is laminated onto the free edges of the contact flanges 10 and onto the cavity-side surfaces 11 of the contact flanges 10 and onto the adjacent end sections (bridge sections) 21 of the connecting flange 20.

At a center piece 22 of the connecting flange 20, the metal foil 40 is arranged at a distance from the connecting flange 20, whereby a cavity is formed, which can be used as desiccant cavity 30. Here, the center piece 22 of the connecting flange 20 forms the inner wall of the desiccant cavity 30, while the metal foil 40 forms the other three walls 32, 34, 36 of the desiccant cavity 30, which possesses an essentially rectangular cross-section.

The center piece 22 of the connecting flange 20 is provided in the area of the desiccant cavity 30 with perforations 23, so that in installed state moisture from the interior of the double-glazing unit can be absorbed by the desiccant (not shown) introduced into the desiccant cavity 30.

Figure 2:
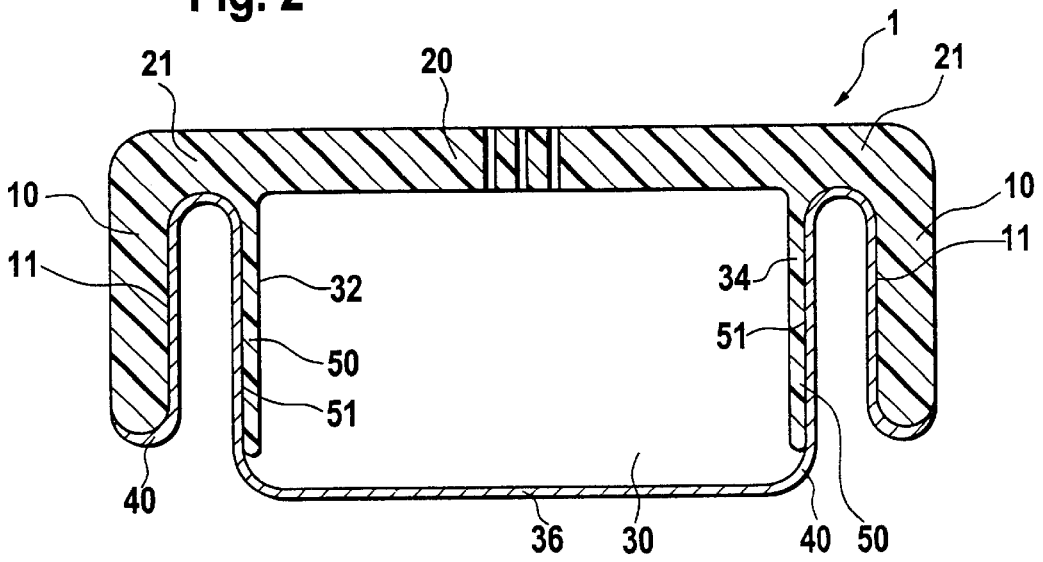
FIG. 2 a second embodiment of the spacing profile according to the invention.

FIG. 2 shows a second embodiment of a spacing profile according to the invention in cross-section. Here, the profile body, in the example again manufactured from polypropylene Novolen 1040 K, consists of contact flanges 10 and a connecting flange 20, where from the ends of the center piece 22 of the connecting flange 20 project two thin reinforcing layers 50, which are joined to the inner surfaces 51 of the side walls 32, 34 of the desiccant cavity 30 and also consist of polypropylene Novolen 1040 K. The metal foil 40 is laminated onto the edges of the contact flanges 10 as well as onto those surfaces of the contact flanges 10, facing the cavity and the adjacent end sections 21 of the connecting flange 20, and in addition forms the outer wall 36 as well as the side walls 32, 34 of the desiccant cavity 30 adjacent thereto at a right angle. The reinforcing layers 50 stabilizing the side walls 32, 34 possess a thickness of approximately 0.25 mm, which corresponds to approximately one quarter of the thickness of the profile body, that is to say the thickness of the connecting flange 20 and the contact flanges 10.

As metal foil 40 was used for the example a tinned sheet iron foil (tinplate foil) with a thickness of 0.125 mm.

The chemical composition of this sheet iron was (in weight percent): Carbon 0.07%, manganese 0.400%, silicon 0.018%, aluminium 0.045%, phosphorus 0.020%, nitrogen 0.007%, remainder iron.

To the sheet was applied a coating of tin with a mass per unit area of 2.8 g/m$^2$, which corresponds to a thickness of 0.38 $\mu$m.

Figure 3:
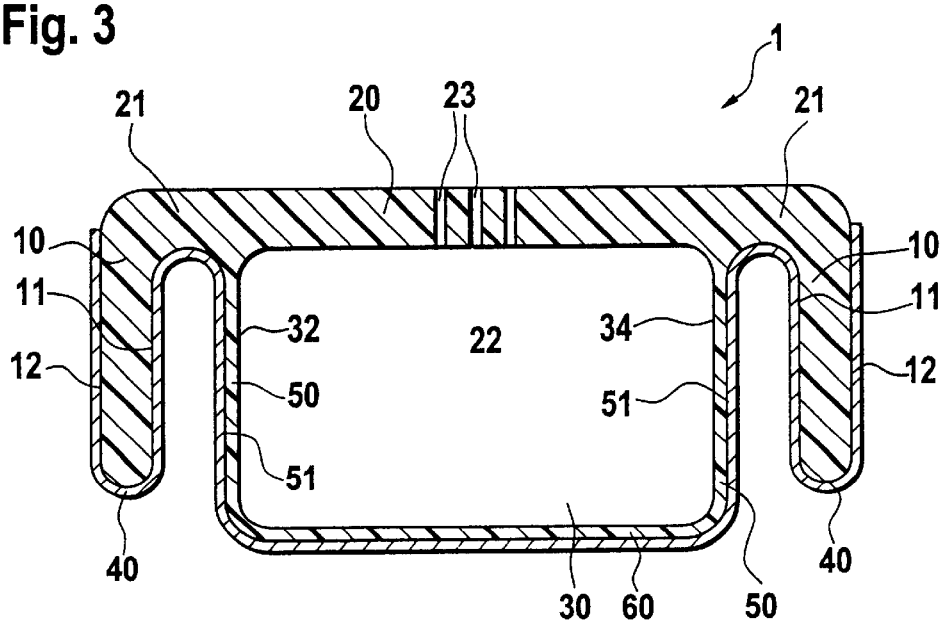
FIG. 3 a third embodiment of the spacing profile according to the invention.

FIG. 3 illustrates a further embodiment of a spacing profile according to the invention in cross-section. To the profile body, consisting of contact flanges 10 and the connecting flange 20, is joined a desiccant cavity 30 formed by a metal foil 40 and the center piece 22 of the connecting flange 20, whose side walls 32, 34 are joined to thin stabilizing reinforcing layers 50 and its outer wall is joined to a further thin stabilizing layer 60.

All reinforcing layers 50, 60 have in the examples illustrated, like the profile body, been manufactured from polypropylene Novolen 1040 K. They possessed a thickness of 0.15 mm, which corresponded to approximately 15% of the thickness of the connecting flange 20. As metal foil 40 a stainless steel foil with a thickness of 0.05 mm was used. It had been laminated onto the contact surface 12 of contact flanges 10 facing towards the insides of the panes in installed state, the edges of contact flanges 10, the cavity-side surfaces 11 of the contact flanges 10 and the adjacent end sections 21 of the connecting flange 20, and in addition formed, as mentioned, the side walls 32, 34 and the outer wall 36 of the desiccant cavity 30.

The chemical composition of the stainless steel used for the metal foil 40 was (in weight percent): Chromium 19 to 21%, carbon maximum 0.03%, manganese maximum 0.50%, silicon maximum 0.60%, aluminium 4.7 to 5.5%, remainder iron.

Figure 4:
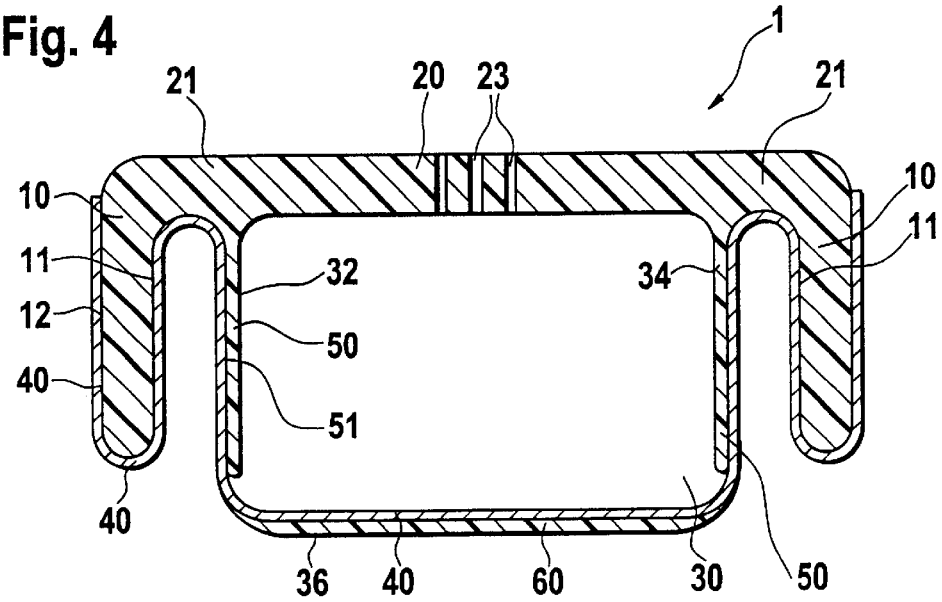
FIG. 4 a fourth embodiment of the spacing profile according to the invention, and FIG. 5 a fifth embodiment of the spacing profile according to the invention.

FIG. 4 illustrates a further embodiment of a spacing profile according to the invention, which differs from the embodiment illustrated in FIG. 3 by the fact that the reinforcing coating 60 joined to the outer wall 36 of the desiccant cavity 30 formed by the metal foil 40 is arranged on the outside of the outer wall 36, thus protecting the latter more efficiently from mechanical and chemical impairment.

The spacing profiles according to FIGS. 1 to 4 could be cold-bent to form a rectangular spacing frame without undesired deformations in a standard automatic bending machine customary in commerce.

Figure 5:
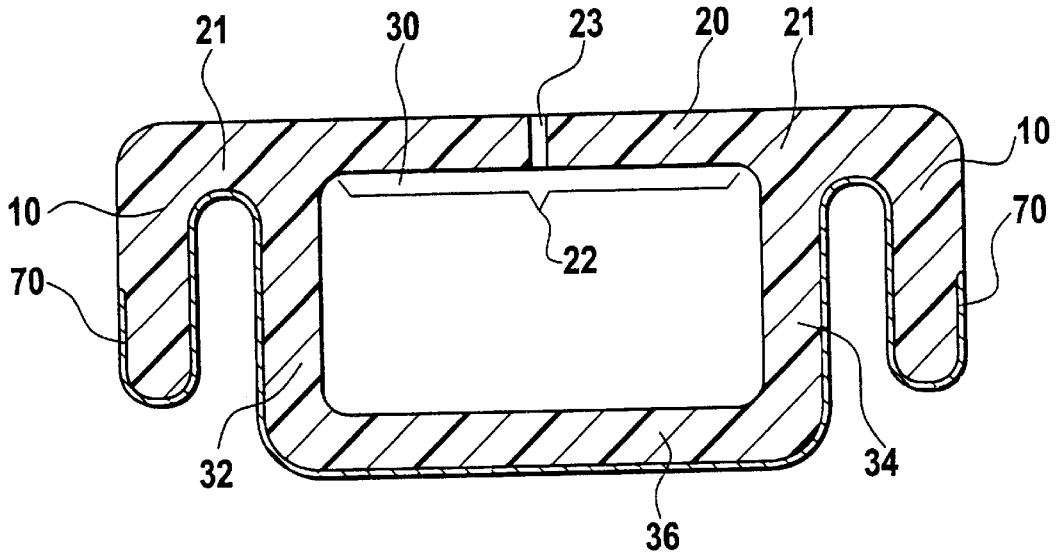

FIG. 5 shows a fifth embodiment of the spacing profile according to the invention having a profile body according to DE 298 14 768 U1. By walls 32, 34, 36 and the center piece 22 of the connecting flange 20, a desiccant cavity 30 is defined, wherein the gas-conducting connection between this cavity 30 and the interspace is provided by perforations 23. End sections 21 of the connecting flange 20 form, as in the case of FIG. 1, bridge sections between the desiccant cavity 30 and contact flanges 10, the contact flanges 10 comprising each a recess 70 in those surfaces facing to the inside of the panes in the installed state, a metal foil 40 being inserted into the recesses 70. The depth of the recess 70 corresponds exactly to the thickness of the metal foil 40, so that the contact surface formed by the profile body 1 and the contact surface formed by the metal foil 40 lie exactly on one plane. The represented profile shape is subject of the utility model application DE 298 07 418.4 which has an earlier priority date than the present application. In order to avoid repetitions, reference is made to the full content of the utility model application. The metal foil 40 extends substantially from the contact surface of the first contact flange 10 there around to the first end section 21, then around the cavity 30 to the second end section 21 and around the second contact flange 10 to its contact surface. A sheet iron which is chrome-plated and provided with a metal primer layer, the sheet having a thickness of 0.125 mm, has been used as the diffusion-impermeable metal foil 40 establishing a material fit with the profile body 1. Such a diffusion-impermeable iron sheet foil is subject of the utility model application DE 298 07 413.3 which has an earlier priority date than the present patent application and to which reference is also explicitly made. Alternatively, beside further suitable materials, also a stainless steel can be used for the metal foil 40, in this case the thickness being preferably between 0.08 and 0.1 mm. It must be endeavored that independently of the material the elongation at break of the metal foil 40 used should be greater than 15% prior to deformation and attachment to the profile body.

For the profile body, instead of the material polypropylene Novolen 1040 K mentioned in the description to the previous figures, black-tinted plastic materials according to the third aspect of the invention having the following composition were used:

| Material component | Trade name | Proportion in weight % |
|---|---|---|
| Material 1: | | |
| Polypropylene block copolymer with grafted polyethylene content | Borealis BA 101 E natur of Borealis A/S, Lyngby, Denmark | 73% |
| Polypropylene with 20 weight % French chalk content | Borealis MB 200 U natur of Borealis A/S, Lyngby, Denmark | 24% |
| Material 2: | | |
| Polypropylene homopolymer | Adstif 680 ADXP natur of Montell, Wesseling, Germany | 5% |
| Polypropylene block copolymer with grafted polyethylene content | Borealis BA 101 E natur of Borealis A/S, Lyngby, Denmark | 68% |
| Polypropylene with 20 weight % French chalk content | Borealis MB 200 U natur of Borealis A/S, Lyngby, Denmark | 24% |
| Reference Material: | | |
| Polypropylene homopolymer | Adstif 680 ADXP natur of Montell, Wesseling, Germany | 73% |
| Polypropylene with 20 weight % French chalk content | Borealis MB 200 U natur of Borealis A/S, Lyngby, Denmark | 24% |

Each of the plastic materials also contained 1 weight % of a suitable color batch (black pigments), as well as 2 weight % of a UV stabilizer. The plastic materials possessed the mechanical properties shown in the following Table:

| Measured quantity | Material 1 | Material 2 | Reference Material |
|---|---|---|---|
| Bending modulus of elasticity (DIN 53457) | 1,180 N/mm$^2$ | 1,280 N/mm$^2$ | 2,083 N/mm$^2$ |
| Elongation at yield (DIN EN 527-1) | 9.4% | 8.8% | 3.9% |
| Tensile strength at yield (DIN EN ISO 527-1) | 24.8 N/mm$^2$ | 26.3 N/mm$^2$ | 34.8 N/mm$^2$ |
| Elongation at break (DIN EN ISO 527) | >800% | >750% | 4.1% |
| Tensile strength at break (DIN EN ISO 527) | 21.9 N/mm$^2$ | 21.3 N/mm$^2$ | 15.7 N/mm$^2$ |
| Notched impact strength (DIN EN ISO 179) | 29.9 kJ/m$^2$ | 22.0 kJ/m$^2$ | 4.1 kJ/m$^2$ |

-continued

| Measured quantity | Material 1 | Material 2 | Reference Material |
|---|---|---|---|
| Shore D hardness (DIN 53505) | 67 | 69 | 76 |
| Density (DIN 53479) | 0.94 g/cm$^3$ | 0.94 g/cm$^3$ | 0.95 g/cm$^3$ |

The spacing profile according to FIG. 5 was cold-bent in a standard automatic bending machine to form a right-angled spacing frame. It deformed as desired in the area of the corners in the case of materials 1 and 2, without tears in the metal foil 40, foil separation or other undesirable deformation occurring, especially in the areas of the contact flanges 10. When the reference material, which possessed a significantly higher bending modulus of elasticity, and also differed significantly from the other materials in respect of tensile strength at yield, elongation at yield and elongation at break, was used for the profile body on the other hand tears were observed in the most seriously stressed areas of the metal foil 40, so that the spacing profiles produced in this way had to be evaluated as defective.

The features disclosed in the foregoing description, in the claims and/or in the accompanying drawing may, both separately and in any combination thereof, be material for realizing the invention in diverse forms thereof.

What is claimed is:

1. A spacing profile for a spacing frame, which is to be fitted in the edge area of a double-glazing unit, forming an interspace, with a profile body of a material possessing low thermal conductivity, which incorporates contact flanges for contact with the insides of the panes of the double-glazing unit and a connecting flange bridging the interspace in installed state, by means of which at least two contact flanges are joined to one another, where the spacing profile additionally comprises a desiccant cavity, and further a metal foil, which extends essentially over the entire width of the spacing profile, where the metal foil is bonded to establish a material fit to cavity-side surfaces of the contact flanges, as well as to adjacent end sections of the connecting flange, characterized in that only the metal foil together with a center piece of the connecting flange forms the walls of the desiccant cavity.

2. The spacing profile of claim 1, wherein the desiccant cavity possesses two side walls, each of which is essentially parallel to an adjacent contact flange, and an outer wall facing away from the interspace in installed state, running essentially parallel to the connecting flange.

3. The spacing profile of claim 1, wherein the thickness of the connecting flange is between 0.5 mm and 1.5 mm.

4. The spacing profile of claim 1, wherein the metal foil is additionally arranged on the contact surfaces of the contact flanges.

5. The spacing profile of claim 1, wherein the metal foil consists of a metal with an elongation at break of more than 15%.

6. The spacing profile of claim 1, wherein the metal foil consists of stainless steal or sheet iron.

7. The spacing profile of claim 1, wherein the thickness of metal foil is between 0.02 mm and 0.3 mm.

8. The spacing profile of claim 1, wherein the thickness of the metal foil is between 0.1 mm and 0.15 mm.

9. The spacing profile of claim 1, wherein at least for parts of the profile body adjoining the metal foil, a plastic material with a bending modulus of elasticity of less than 1,900 N/mm$^2$ is used.

10. The spacing profile of claim 9, wherein for the contact flanges a plastic material with a bending modulus of elasticity of less than 1,900 N/mm$^2$ is used.

11. The spacing profile of claim 9, wherein the profile body consists entirely of a plastic material with a bending modulus of elasticity of less than 1,900 N/mm$^2$.

12. The spacing profile of claim 9, wherein the plastic material possesses a bending modulus of elasticity of less than 1,500 N/mm$^2$.

13. The spacing profile of claim 9, wherein the plastic material possesses a bending modulus of elasticity of at least 900 N/mm$^2$.

14. The spacing profile of claim 9, wherein the plastic material possesses a tensile strength at yield of less than 38 N/mm$^2$, and an elongation at yield of more than 7%.

15. The spacing profile of claim 9, wherein the plastic material possesses an elongation at break of at least 100%.

16. The spacing profile of claim 9, wherein the plastic material possesses a tensile strength at yield of a maximum of 30 N/mm$^2$, and elongation at yield of at least 8%.

17. The spacing profile of claim 9, wherein the plastic material possess an elongation at break of at least 500%.

18. The spacing profile of claim 9, wherein the plastic material comprises polypropylene as principal constituent.

19. The spacing profile of claim 18, wherein the plastic material comprises a polypropylene block co-polymer wherein said polypropylene block copolymer has grafted polypropylene or polyethylene, as its principal constituent.

20. A spacing profile for a spacing frame, which is to be fitted in the edge area of a double-glazing unit, forming an interspace, with a profile body of a material possessing low thermal conductivity, which incorporates contact flanges for contact with the insides of the panes of the double-glazing unit and a connecting flange bridging the interspace in installed state, by means of which at least two contact flanges are joined to one another, where the spacing profile additionally comprises a desiccant cavity arranged between the contact flanges, and further a metal foil, which extends essentially over the entire width of the spacing profile, where the metal foil is bonded to establish a material fit to cavity-side surfaces of the contact flanges, as well as to adjacent end sections of the connecting flange, characterized in that the metal foil together with a center piece of the connecting flange forms the walls of the desiccant cavity, where at least one of the walls of the desiccant cavity formed by the metal foil is provided with a reinforcing layer of a material possessing low thermal conductivity, whose thickness is a maximum of 50% of the thickness of the connecting flange.

21. The spacing profile of claim 20, wherein the desiccant cavity, possesses two side walls, each of which is essentially parallel to an adjacent contact flange, and an outer wall facing away from the interspace in installed state, running essentially parallel to the connecting flange.

22. The spacing profile of claim 20, wherein the side walls of the desiccant cavity are provided with a reinforcing layer of material possessing low thermal conductivity.

23. The spacing profile of claim 22, wherein the thickness of the reinforcing layer of the side walls is less than one quarter of the thickness of the connecting flange.

24. The spacing profile of claim 20, wherein the thickness of the reinforcing layer of the side walls is less than one third of the thickness of the connecting flange.

25. The spacing profile of claim 20, wherein the outer wall of the desiccant cavity facing away from the interspace in installed state is provided with a reinforcing layer of material possessing low thermal conductivity.

26. The spacing profile of claim 25, wherein the thickness of the reinforcing layer of the outer wall is less than one quarter of the thickness of the connecting flange.

27. The spacing profile of claim 25, wherein the thickness of the reinforcing layer of the outer wall is less than one third of the thickness of the connecting flange.

28. The spacing profile of claim 20, wherein the reinforcing layer is arranged at least partially on the inside of the walls of the desiccant cavity formed by the metal foil.

29. The spacing profile of claim 20, wherein the reinforcing layer consists of the same material as the connecting flange.

30. The spacing profile of claim 20, wherein the reinforcing layer covers the metal foil at least partially on both surfaces.

31. A spacing profile for a spacing frame which is to be fitted in the edge area of a double-glazing unit, forming an interspace, with a profile body of a plastic material possessing low thermal conductivity and with a diffusion-impermeable metal foil which is bonded to the profile body so as to establish a material fit, characterized in that at least for parts of the profile body adjoining the metal foil, a plastic material with a bending modulus of elasticity of less than 1,900 $N/mm^2$, and of at least 900 $N/mm^2$ is used.

32. The spacing profile of claim 31, wherein the profile body comprises contact flanges, having contact surfaces, for contact with the inside of a pane, which are joined by means of bridge sections to a desiccant cavity, wherein the metal foil is joined so as to establish a material fit to the contact surfaces of the contact flanges, the surfaces of the bridge sections facing away from the interspace and the outer surfaces of the walls of the desiccant cavity.

33. The spacing profile of claim 31 wherein the bending modulus of elasticity is less than 1,500 $N/mm^2$, but is at least 900 $N/mm^2$.

* * * * *